US012540003B2

(12) United States Patent
Whitener

(10) Patent No.: US 12,540,003 B2
(45) Date of Patent: Feb. 3, 2026

(54) QUICK ASSEMBLY BOX

(71) Applicant: CrimsonStark LLC, Reno, NV (US)

(72) Inventor: Sean A. Whitener, Oberhaching (DE)

(73) Assignee: CrimsonStark LLC, Reno, NV (US)

( * ) Notice: Subject to any disclaimer, the term of this patent is extended or adjusted under 35 U.S.C. 154(b) by 0 days.

(21) Appl. No.: 18/999,776

(22) Filed: Dec. 23, 2024

(65) Prior Publication Data

US 2025/0206494 A1 Jun. 26, 2025

Related U.S. Application Data

(63) Continuation of application No. 18/988,284, filed on Dec. 19, 2024.

(60) Provisional application No. 63/613,497, filed on Dec. 21, 2023.

(51) Int. Cl.
*B65D 5/36* (2006.01)
*B65D 5/42* (2006.01)

(52) U.S. Cl.
CPC ..... *B65D 5/3664* (2013.01); *B65D 5/4266* (2013.01)

(58) Field of Classification Search
CPC .. B65D 5/3664; B65D 5/4266; B65D 5/3678; B65D 5/6655; B65D 5/3628; B65D 5/443; B65D 5/0005; B65D 5/36; B65D 5/3607
USPC .... 229/117.08, 186, 117.05, 117.07, 117.01, 229/190, 920
See application file for complete search history.

(56) References Cited

U.S. PATENT DOCUMENTS

| | | | | |
|---|---|---|---|---|
| 888,653 | A * | 5/1908 | Potter | B65D 33/06 D9/706 |
| 5,460,324 | A * | 10/1995 | Vinther | B65D 5/3664 229/405 |
| 7,487,904 | B2 * | 2/2009 | McClure | B65D 5/3678 229/920 |
| 7,841,512 | B2 * | 11/2010 | Westerman | B65D 5/6697 229/149 |
| 9,656,779 | B2 * | 5/2017 | Arki | B65D 5/46144 |
| 11,214,428 | B2 * | 1/2022 | Costanzo, Jr. | B65D 5/4266 |
| 2014/0339227 | A1 | 11/2014 | Chalifoux | |

FOREIGN PATENT DOCUMENTS

| | | |
|---|---|---|
| EP | 3597550 | 1/2020 |
| FR | 8765 E | 6/1908 |
| FR | 2241459 | 3/1975 |
| FR | 2781761 | 2/2000 |
| GB | 1603429 | 11/1981 |
| GB | 2170478 | 8/1986 |
| WO | 2007051238 | 5/2007 |
| WO | 2017081430 | 5/2017 |

* cited by examiner

*Primary Examiner* — Christopher R Demeree
(74) *Attorney, Agent, or Firm* — McDonnell Boehnen Hulbert & Berghoff LLP

(57) ABSTRACT

The present disclosure relates generally to a foldable moving box that can be quickly unfolded from a generally flat stored position into an open and packable configuration. The box may comprise scored panels that allow the box to be folded in such a way that the box is relatively compact when in the generally flat stored position and that the box may be quickly unfolded to an open and packable configuration.

20 Claims, 12 Drawing Sheets

QUICK ASSEMBLY BOX

CROSS-REFERENCE TO OTHER APPLICATIONS

The present application is a continuation application of U.S. patent application Ser. No. 18/988,284, filed Dec. 19, 2024, which claims the benefit of U.S. Provisional Patent Application No. 63/613,497, filed Dec. 21, 2023, the entire contents of each of which are incorporated herein by reference.

FIELD

The present disclosure relates generally to a foldable moving box that can be quickly unfolded from a generally flat stored position into an open and packable configuration.

BACKGROUND

Cardboard boxes are commonly used for shipping and moving objects. Such cardboard boxes are often purchased in a generally flat, folded, unassembled configuration. A user must unfold the flat box, fold the box into a packable configuration, and then tape the cardboard flaps to form a packable box. Once packed, the box may be taped shut. This process tends to be time consuming, particularly when multiple boxes need to be assembled, and requires additional tools such as tape and potentially scissors. Further, most boxes have a bottom that is formed of two flaps of cardboard taped together. The taped-together bottom flaps may be a point of structural weakness that limits the weight than can be placed into the box.

There exists a need for an improved moving box that can quickly be unfolded from a stored configuration into a packing configuration without additional tools. In addition, the stored configuration should have a relatively small footprint, such that the box should not occupy a substantially greater surface area when in a stored, folded configuration as compared to when the box is in an open and packable configuration.

SUMMARY

According to an aspect of the present disclosure, a quick-assembly box may be configured to be unfolded from a stored configuration into an open and packable configuration. The quick-assembly box may comprise: a base panel comprising a first base longitudinal edge opposing a second base longitudinal edge, and a first base lateral edge opposing a second base lateral edge; a first main wall panel that is attached to the base panel along the first base longitudinal edge, wherein the first main wall panel comprises a first distal main wall longitudinal edge opposing the first base longitudinal edge, and two opposing main wall lateral edges that extend from the first base longitudinal edge to the first distal main wall longitudinal edge; a second main wall panel that is attached to the base panel along the first base longitudinal edge, wherein the second main wall panel comprises a second distal main wall longitudinal edge opposing the second base longitudinal edge, and two opposing main wall lateral edges that extend from the second base longitudinal edge to the second distal main wall longitudinal edge; a first scored sidewall panel that is attached to the base panel along the first base lateral edge, wherein the first scored sidewall panel comprises a first proximal scoring pattern, and a first distal sidewall edge opposing the first base lateral edge; a second scored sidewall panel that is attached to the base panel along the second base lateral edge, wherein the second scored sidewall panel comprises a second proximal scoring pattern, and a second distal sidewall edge opposing the second base lateral edge; a first top panel that is attached to the first main wall panel along the first distal main wall longitudinal edge; and a second top panel that is attached to the second main wall panel along the second distal main wall longitudinal edge. The first and second proximal scoring patterns may allow at least a lower portion of the first and second scored sidewall panels to fold towards the base panel when the box is folded into the stored configuration.

According to an aspect of the present disclosure, the first scored sidewall panel may include a first proximal scored sidewall section comprising the first proximal scoring pattern, a first distal scored sidewall section comprising an outer surface and a first distal scoring pattern, and a first lateral scoring pattern that divides the first proximal scored sidewall section from the first distal scored sidewall section.

According to an aspect of the present disclosure, the first proximal scoring pattern may comprise two score lines extending from opposite ends of the first base lateral edge and converging where the first proximal scoring pattern meets the first lateral scoring pattern.

According to an aspect of the present disclosure, the first distal scoring pattern may comprise a score line that extends perpendicular from the first distal sidewall edge to the first lateral scoring pattern, wherein the first distal scoring pattern allows the first distal scored sidewall section to fold such that the outer surface folds in on itself when the box is folded into the stored configuration.

According to an aspect of the present disclosure, the first lateral scoring pattern may comprise a score line that extends substantially parallel to the first base lateral edge, wherein the first lateral scoring pattern allows the first distal scored sidewall section to fold such that the outer surface remains substantially flat and the first distal scored sidewall section folds towards the base panel when the box is unfolded into the open and packable configuration.

According to an aspect of the present disclosure, the second scored sidewall panel may include a second proximal scored sidewall section comprising the second proximal scoring pattern, a second distal scored sidewall section comprising an outer surface and a second distal scoring pattern, and a second lateral scoring pattern that divides the second proximal scored sidewall section from the second distal scored sidewall section.

According to an aspect of the present disclosure, the second proximal scoring pattern is the same as the first proximal scoring pattern, the second distal scoring pattern is the same as the first distal scoring pattern, and the second lateral scoring pattern is the same as the first lateral scoring pattern.

According to an aspect of the present disclosure, the quick-assembly box may further comprise a first and second tab attached to the first main wall panel at each of the opposing main wall lateral edges and a third and fourth tab attached to the second main wall panel at each of the opposing main wall lateral edges. The first and second tab may be attached to the first and second scored sidewall panel respectively and the third and fourth tab may be attached to the first and second scored sidewall panel respectively.

According to an aspect of the present disclosure, the first, second, third, and fourth tabs may be permanently attached to the first and second scored sidewall panels.

According to an aspect of the present disclosure, the first proximal scoring pattern may comprise two score lines extending from opposite ends of the first base lateral edge and converging where the first proximal scoring pattern meets the first lateral scoring pattern. The second proximal scoring pattern may comprise two score lines extending from opposite ends of the second base lateral edge and converging where the second proximal scoring pattern meets the second lateral scoring pattern. The first, second, third, and fourth tabs may be triangular. The hypotenuse of each triangular tab may align with one of the score lines of the first and second proximal scoring patterns.

According to an aspect of the present disclosure, when the box is folded into the stored configuration, either the first top panel folds onto the first main wall panel with the second top panel then folding on top of the first top panel, or the second top panel folds onto the second main wall panel with the first top panel then folding on top of the second top panel.

According to an aspect of the present disclosure, the overall surface area occupied by the box in the stored configuration may be no more than 5% greater than the surface area of the base panel.

According to an aspect of the present disclosure, the quick-assembly box may be formed from a single, unitary piece of material, with crease or score lines or joins or attachments between the different panels.

According to an aspect of the present disclosure, the base panel may be a unitary piece of material with no crease or score lines within the base panel.

According to an aspect of the present disclosure, the first and second main wall panels may each be a unitary piece of material with no crease or score lines within each main wall panel.

According to an aspect of the present disclosure, the second top panel may further comprise a seal that is configured to attach to the first top panel to seal the box from an open and packable configuration into a closed and packed configuration.

According to an aspect of the present disclosure, the second top panel may further comprise a protruding area, and wherein the seal is located within the protruding area.

According to an aspect of the present disclosure, the first top panel, the second top panel, or both, may further comprise a fastener that is configured to attach the first and second top panels together to maintain the box in the stored configuration.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The following is a description of the examples depicted in the accompanying drawings. The figures are not necessarily to scale, and certain features and certain views of the figures may be exaggerated in scale or in schematic for clarity or conciseness.

Figure 1:
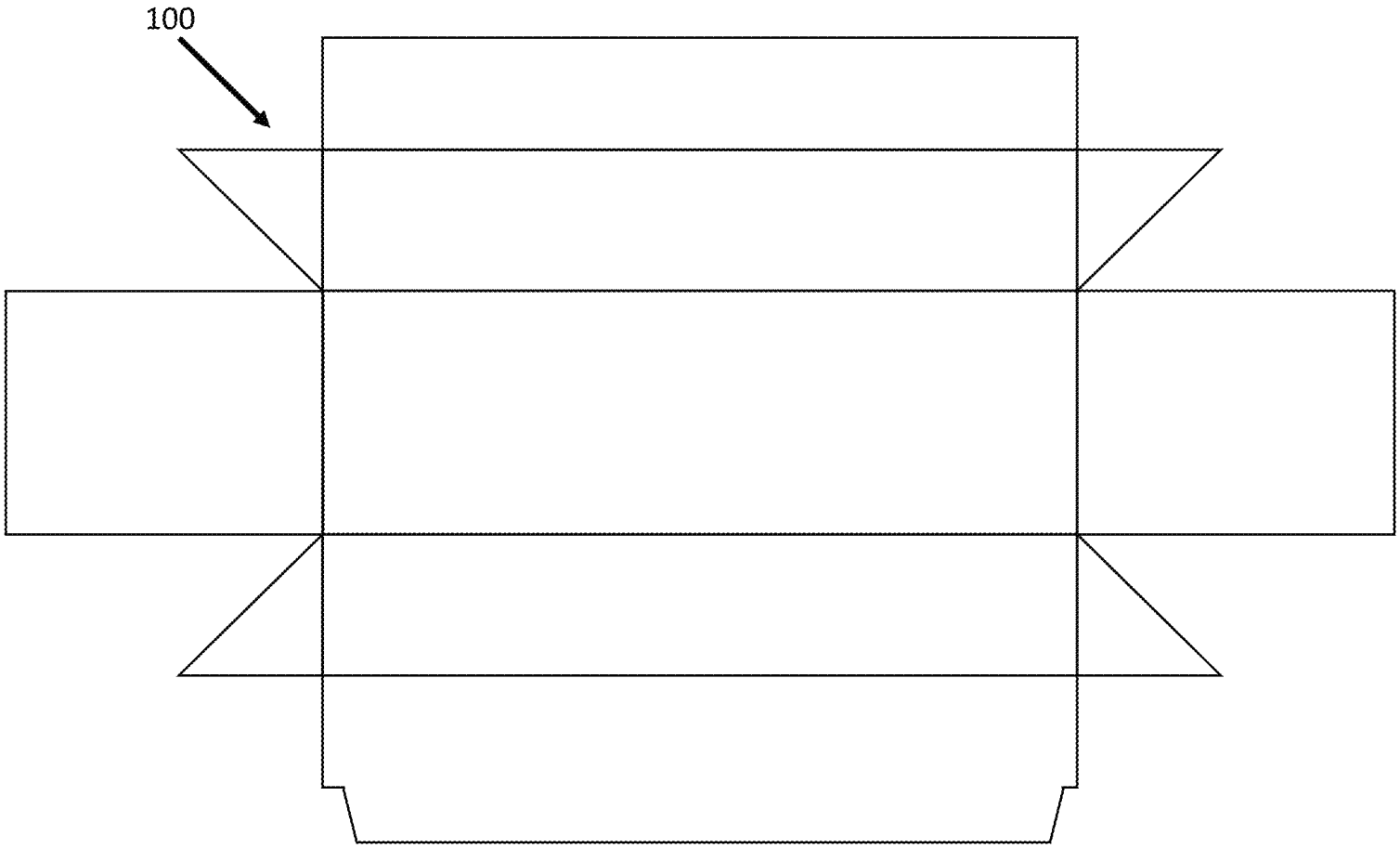
FIG. 1 illustrates a top plan view of a box die according to the present disclosure.

The foregoing summary, as well as the following detailed description, will be better understood when read in conjunction with the figures. It should be understood that the claims are not limited to the arrangements and instrumentality shown in the figures. Furthermore, the appearance shown in the figures is one of many ornamental appearances that can be employed to achieve the stated functions of the apparatus.

DETAILED DESCRIPTION

In the following detailed description, specific details may be set forth to provide a thorough understanding of the embodiments of the present disclosure. However, it will be clear to one skilled in the art when disclosed examples may be practiced without some or all of these specific details. For the sake of brevity, well-known features or processes may not be described in detail. In addition, like or identical reference numerals may be used to identify common or similar elements.

One or more specific embodiments of the present disclosure will be described below. In an effort to provide a concise description of these embodiments, all features with an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

FIG. 1 illustrates a top plan view of a box die 100 of an embodiment of a quick assembly box according to the present disclosure. According to certain aspects of the present disclosure, the box die 100 may be formed of a single, unitary piece of material comprising separate panels, with crease or score lines between the panels. The box die 100 may be assembled to form a box formed of a single, unitary piece of material. According to another aspect of the present disclosure, the box die 100 may be formed of more than one piece of material, with joins or attachments between two or more of the panels. Such a box die 100 may be assembled to form a box formed of more than one piece of material.

According to certain aspects of the present disclosure, the box die 100 may be formed of cardboard. The cardboard may be, for example, F, E, B, or C, flute single wall cardboard. An advantage of using F or E flute single wall cardboard may be that the box can be made of thinner cardboard. With the construction described in the present disclosure, including that the box has a base panel, F flute single wall cardboard may provide sufficient strength even when the box is filled with relatively heavy objects. The design of the box may be optimized to use the least material necessary without compromising strength and functionality, in order to reduce resource consumption and waste.

According to certain embodiments, the cardboard may be recycled cardboard made from post-consumer or post-industrial waste. Benefits to using recycled materials reduces the need for virgin materials, supports recycling industries, and is widely accepted in recycling programs. According to certain embodiments, the cardboard may be made from FSC-certified (Forest Stewardship Council-certified) paper. Benefits to using FSC-certified paper ensures the paper comes from responsibly managed forests that provide environmental, social, and economic benefits. Alternatively, the box die 100 may be formed of a different material such as plastic, wood, or metal. According to certain embodiments, the box may be made in whole or in part from plant-based plastics, such as bioplastics made from renewable resources, like cornstarch or sugarcane. Benefits to using plant-based plastics may include that such plastics are typically biodegradable and have a lower carbon footprint than conventional plastics. According to certain embodiments, the box may be made in whole or in part from mycelium-based (mushroom-based) materials or hemp-based materials, for example, for internal padding or structural support. Benefits to using mycelium-based materials or hemp-based materials may include that such materials are fully compostable and grown using agricultural waste, and may offer a sustainable alternative to foams and plastics. Where the box die 100 is formed of more than one piece of material, the box die may comprise multiple different materials, such as a combination of metal and cardboard, metal and plastic, or cardboard and plastic, and/or a combination of any of the above materials.

Any printing on the box may use traditional petroleum-based inks or soy- or vegetable-based inks. Advantages of using soy- or vegetable-based ink include that they are more environmentally friendly, emit fewer volatile organic compounds (VOCs), and are easier to remove during recycling.

Adhesives used in construction of the box or to seal the box shut may include solvent-based or water-based adhesives. Advantages to using water-based adhesives include that they are less toxic and reduce exposure to harmful chemicals during manufacturing and recycling. An alternative to adhesives, particularly for sealing the box shut, may include Velcro or another reusable closure material. Advantages of using Velcro include that users may be more inclined to keep and reuse the boxes, which may reduce overall consumption and waste.

As used in the present disclosure, the term "crease" or "score" may refer to a folded or bended crease line, as well as to a scored or cut fold line. Certain creases or scores may bend in a single direction (e.g., from a "flat" position to a 90 degree bend in a single direction) whereas other creases or scores may bend in two directions (e.g., from a "flat" position to 90 degrees in either direction). How the crease bends may depend on where the crease is used in the box. In some examples, more than one crease or score may be used.

Figure 2:
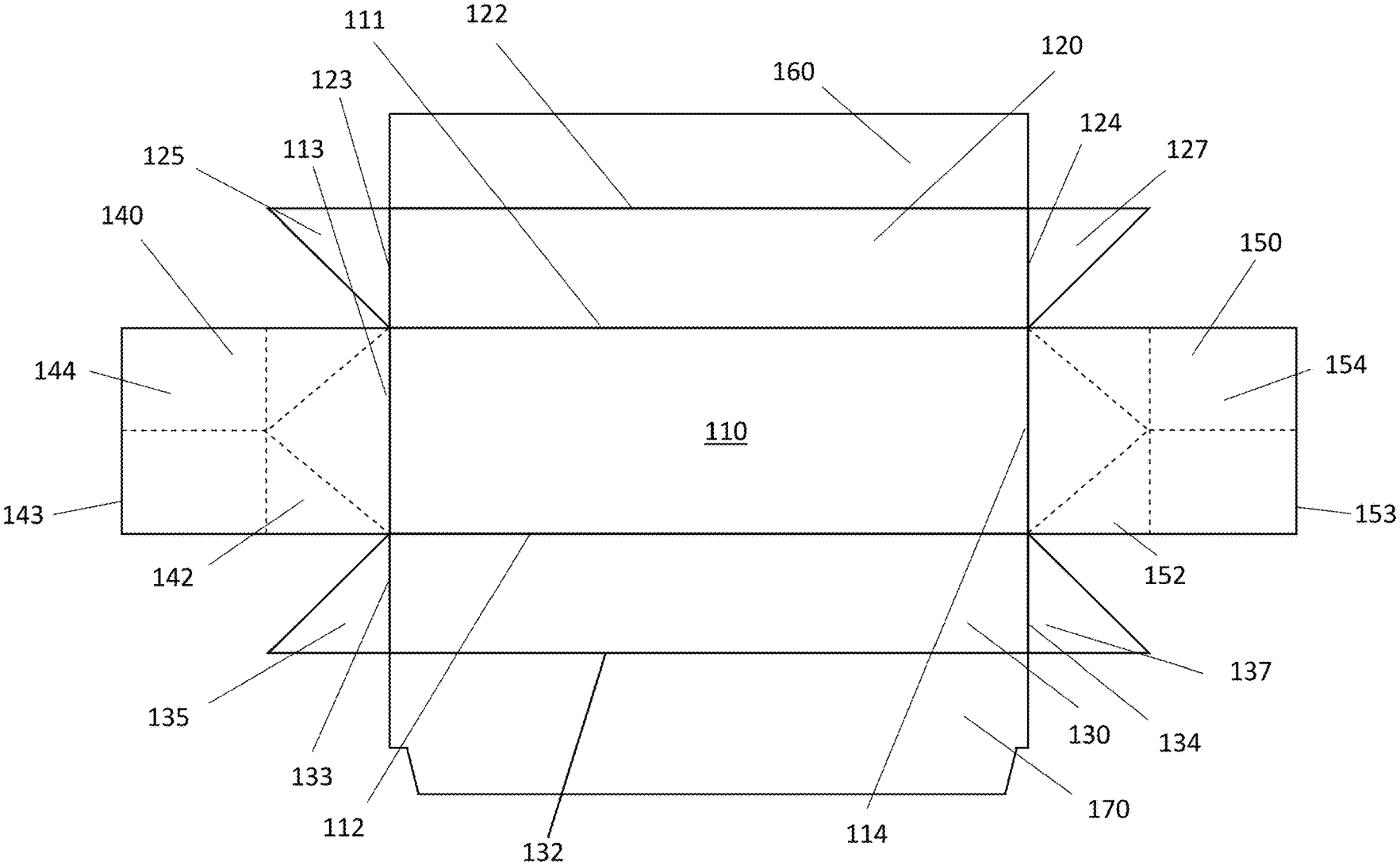
FIG. 2 illustrates a bottom plan view of a box die according to the present disclosure.
Figure 3:
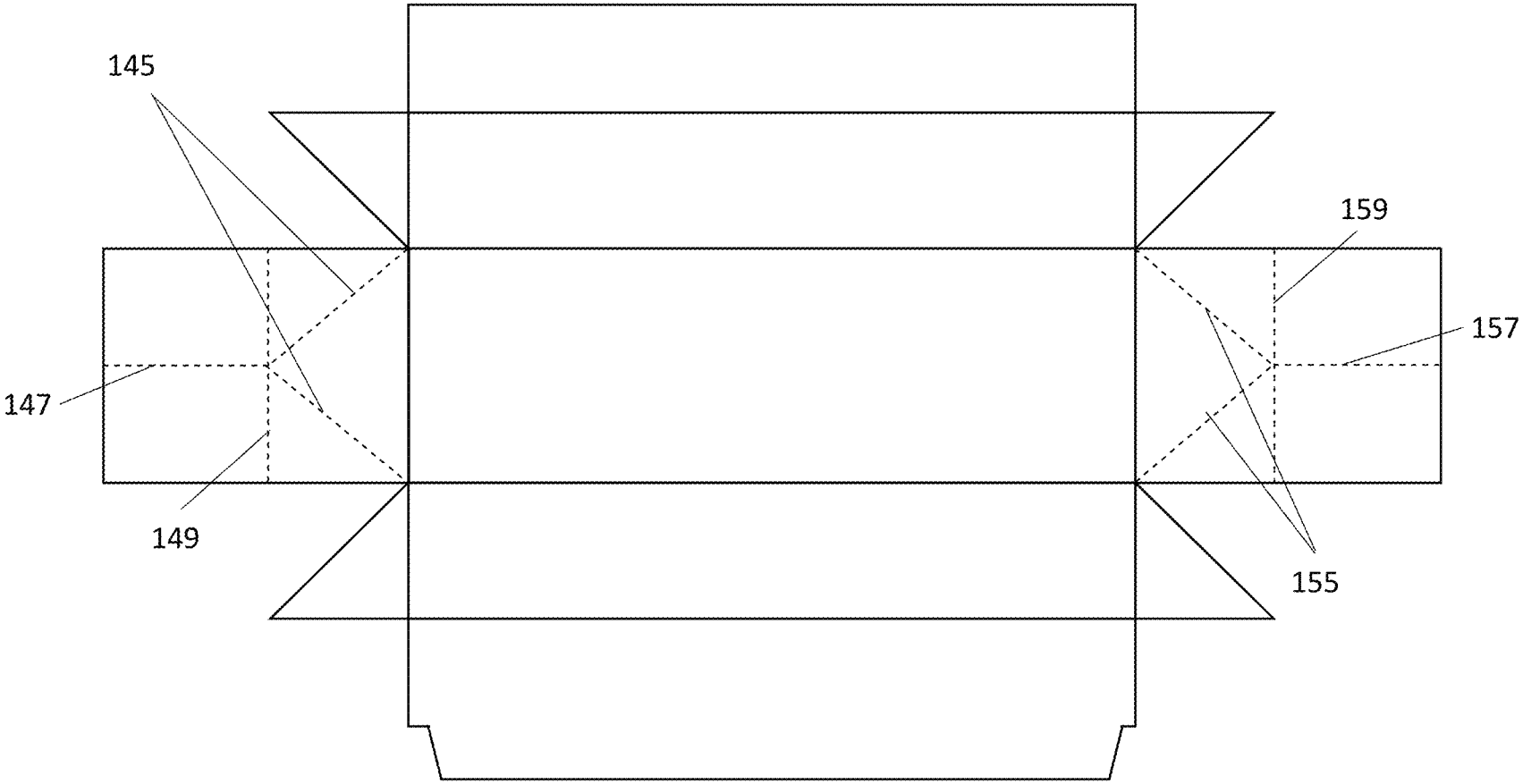
FIG. 3 illustrates a bottom plan view of a box die according to the present disclosure, showing an example scoring pattern.

In this description, the term "box" may be used, which may describe a box that has been assembled using a box die, such as the box die 100 shown in FIGS. 1-3. Alternatively, a box may be assembled from a different box die than the one shown in FIGS. 1-3. For ease of reference, this specification may interchangeably refer components of an assembled box or an unassembled box die.

FIG. 2 illustrates a bottom plan view of the box die 100. The box die 100 may comprise a base panel 110. The base panel 110 may comprise a first base longitudinal edge 111 opposing a second base longitudinal edge 112, and a first base lateral edge 113 opposing a second base lateral edge 114. According to certain aspects of the present disclosure, the base panel 110 may be formed of a unitary piece of material with no crease or score lines within the main plane of the base panel 110. Having no crease or score lines within the main plane of the base panel 110 may enhance the strength of the base panel 110, thus potentially allowing an assembled box to contain more or heavier packing materials.

A first main wall panel 120 may be attached to the base panel along the first base longitudinal edge 111. The first main wall panel 120 may further comprise a first distal main wall longitudinal edge 122 that opposes the first base longitudinal edge 111. The first main wall panel 120 may further comprise two opposing main wall lateral edges 123, 124 that each extend from the first base longitudinal edge 111 to the first distal main wall longitudinal edge 122. According to certain aspects of the present disclosure, the first main wall panel 120 may be formed of a unitary piece of material with no crease or score lines within the main plane of the first main wall panel 120, which may enhance the strength of the first main wall panel 120.

A second main wall panel 130 may be attached to the base panel along the second base longitudinal edge 112. The second main wall panel 130 may further comprise a second distal main wall longitudinal edge 132 that opposes the second base longitudinal edge 112. The second main wall panel 130 may further comprise two opposing main wall lateral edges 133, 134 that each extend from the second base longitudinal edge 112 to the second distal main wall longitudinal edge 132. According to certain aspects of the present disclosure, the second main wall panel 130 may be formed of a unitary piece of material with no crease or score lines within the main plane of the second main wall panel 130, which may enhance the strength of the second main wall panel 130.

A first scored sidewall panel 140 may be attached to the base panel along the first base lateral edge 113. The first scored sidewall panel 140 may comprise a first distal sidewall edge 143 opposing the first base lateral edge 113. The first scored sidewall panel 140 may be divided into a first proximal scored sidewall section 142 that comprises a first proximal scoring pattern 145 and a first distal scored sidewall section 144 that comprises a first distal scoring pattern 147. A first lateral scoring pattern 149 may divide the first proximal scored sidewall section 142 from the first distal scored sidewall section 144. The first proximal scoring pattern 145 may be configured to allow the first proximal scored sidewall section to fold inwards towards the base panel 110 when the box is in a stored folded configuration, and to be generally flat when the box is in an open and packable configuration. The first distal scoring pattern 147 may be configured to allow the first distal scored sidewall section 144 to fold outwards away from the base panel 110 when the box is in a stored folded configuration, and to be generally flat when the box is in an open and packable configuration. In other words, the first distal scoring pattern 147 may allow the first distal scored sidewall section 144 to fold such that the outer surface of the first distal scored sidewall section folds in on itself when the box is folded into the stored configuration. The first distal scoring pattern 147 may comprise a score line that extends perpendicular from the first distal sidewall edge 143 to the first lateral scoring pattern 149. The first lateral scoring pattern 149 may be configured to allow the first distal scored sidewall section 144 as a whole to fold inwards towards the base panel 110 after the box has been packed so that the box may then be closed. The first lateral scoring pattern 149 may comprise a score line that extends parallel to the second base lateral edge 113.

According to certain aspects of the present disclosure, the first proximal scoring pattern 145 may comprise two score lines that extend from opposite ends of the first base lateral edge 113 to converge where the first proximal scoring pattern 145 meets the first lateral scoring pattern 149. In such an embodiment, the two score lines may extend from the corners of the first base lateral edge 113 (i.e., where the first base lateral edge 113 meets the first and second base longitudinal edges 111, 112). Alternatively, if the box will still fold as intended, the two score lines may extend from points away from the corners of the first base lateral edge 113.

A second scored sidewall panel 150 may be attached to the base panel along the second base lateral edge 114. The second scored sidewall panel 150 may comprise a second distal sidewall edge 153 opposing the second base lateral edge 114. The second scored sidewall panel 150 may be divided into a second proximal scored sidewall section 152 that comprises a second proximal scoring pattern 155 and a second distal scored sidewall section 154 that comprises a second distal scoring pattern 157. A scored lateral scoring pattern 159 may divide the second proximal scored sidewall section 152 from the second distal scored sidewall section 154. The second proximal scoring pattern 155 may be configured to allow the second proximal scored sidewall section to fold inwards towards the base panel 110 when the box is in a stored folded configuration, and to be generally flat when the box is in an open and packable configuration. The second distal scoring pattern 157 may be configured to allow the second distal scored sidewall section 154 to fold outwards away from the base panel 110 when the box is in a stored folded configuration, and to be generally flat when the box is in an open and packable configuration. In other words, the second distal scoring pattern 157 may allow the second distal scored sidewall section 154 to fold such that the outer surface of the second distal scored sidewall section folds in on itself when the box is folded into the stored configuration. The second distal scoring pattern 157 may comprise a score line that extends perpendicular from the second distal sidewall edge 153 to the second lateral scoring pattern 159. The second lateral scoring pattern 159 may be configured to allow the second distal scored sidewall section 154 as a whole to fold inwards towards the base panel 110 after the box has been packed so that the box may then be closed. The second lateral scoring pattern 159 may comprise a score line that extends parallel to the second base lateral edge 114.

According to certain aspects of the present disclosure, the second proximal scoring pattern 155 may comprise two score lines that extend from opposite ends of the second base lateral edge 114 to converge where the second proximal scoring pattern 155 meets the second lateral scoring pattern 159. In such an embodiment, the two score lines may extend from the corners of the second base lateral edge 114 (i.e., where the second base lateral edge 114 meets the first and second base longitudinal edges 111, 112). Alternatively, if the box will still fold as intended, the two score lines may extend from points away from the corners of the second base lateral edge 114.

A first top panel 160 comprising a first top panel longitudinal edge 161 may be attached to the first main wall panel 120 along the first distal main wall longitudinal edge 122.

A second top panel 170 comprising a second top panel longitudinal edge 171 may be attached to the second main wall panel 130 along the second distal main wall longitudinal edge 132. In certain embodiments, the second top panel may include a seal, such as an adhesive such as a tape strip that allows the second top panel 170 to be taped onto the first top panel 160 when the box is closed. In certain embodiments, the seal may be located with a protruding area 175 within the second top panel 170.

The first top panel 160, the second top panel 170, or both may comprise a fastener that can be used to maintain the box in the folded stored configuration. In certain embodiments, the fastener may be configured to attach the first and second top panels together to maintain the box in the stored configuration. In certain other embodiments, the fastener that is configured to attach one of the first and second top panels to the base panel to maintain the box in the stored configuration. Optionally, the fastener could comprise an adhesive, a hook, or Velcro.

In certain embodiments, the fastener may be a separate component from the box and may not be attached to either of the first top panel 160 or the second top panel 170. For example, the fastener may be a wrap, such as an elastic band, that is configured to wrap around the box in the folded stored configuration to maintain the box in the folded stored configuration.

According to certain aspects of the present disclosure, first and second tabs 125, 127 may be attached to the first main wall panel 120 at each of the opposing main wall lateral edges 123 and 124, respectively. Similarly, according to certain aspects of the present disclosure, third and fourth tabs 135, 137 may be attached to the second main wall panel 130 at each of the opposing main wall lateral edges 133 and 134, respectively. Each of the tabs 125, 127, 135, 137 may be configured to overlap and attach to the first and second scored sidewall panels 140, 150. Typically, the first and third tabs 125, 135 would overlap and attach to the first scored sidewall panel 140, and the second and fourth tabs 127, 137 would overlap and attach to the second scored sidewall panel 150. While the tabs 125, 127, 135, 137 may be fixedly (e.g., permanently) or temporarily attached to the first and second scored sidewall panels 140, 150, typically the tabs will be fixedly attached. The attachment could be made by an adhesive, such as glue or tape. Typically, the first and third tabs 125, 135 will be configured to align with the first proximal scoring pattern, to allow the first proximal scored sidewall section 142 to fold inwards towards the base panel 110. Similarly, typically, the second and fourth tabs 127, 137 will be configured to align with the second proximal scoring pattern, to allow the second proximal scored sidewall section 152 to fold inwards towards the base panel 110. For example, according to certain embodiments, the tabs 125, 127, 135, 137 may be triangular in shape (e.g., right angled triangles) with the hypotenuse of each triangular-shaped tab configured to attach and align with the first and second proximal scoring patterns 145, 155 when the first and second proximal scoring patterns 145, 155 each comprise two score lines that extend from opposite ends of the relevant base lateral edge (113 or 114) to converge where the first or second proximal scoring pattern (145 or 155) meets the relevant lateral scoring pattern (149 or 159).

FIG. 3 illustrates the same bottom plan view of the box die 100 as FIG. 2, but with a focus on the scoring patterns within the first and second scored sidewall panels 140, 150. As shown in FIG. 3, the first lateral scoring pattern 149 may comprise a score line that extends at least substantially parallel to the first base lateral edge 113. The first lateral scoring pattern 149 may allow the first distal scored sidewall section 144 to fold such that the outer surface remains substantially flat and the first distal scored sidewall section 144 folds outwards away from the base panel 110 when the box is unfolded into the open and packable configuration, and inwards towards the base panel 110 when the box is then closed. Similarly, as shown in FIG. 3, the second lateral scoring pattern 159 may comprise a score line that extends at least substantially parallel to the second base lateral edge 114. The second lateral scoring pattern 159 may allow the second distal scored sidewall section 154 to fold such that the outer surface remains substantially flat and the first distal scored sidewall section 144 folds outwards away from the base panel 110 when the box is unfolded into the open and packable configuration, and inwards towards the base panel 110 when the box is then closed.

Figure 4A:
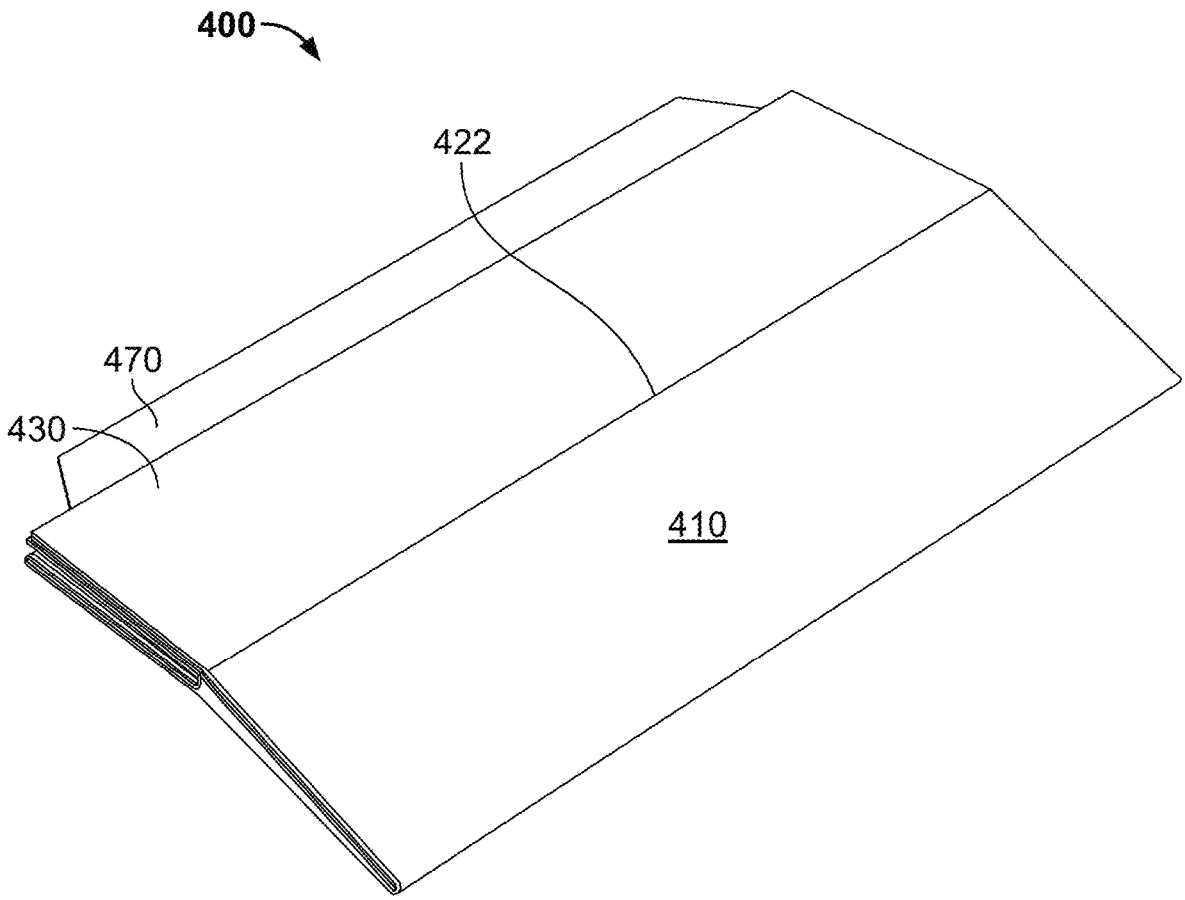
FIG. 4A illustrates a view of a box according to the present disclosure in a folded stored configuration.
Figure 4B:
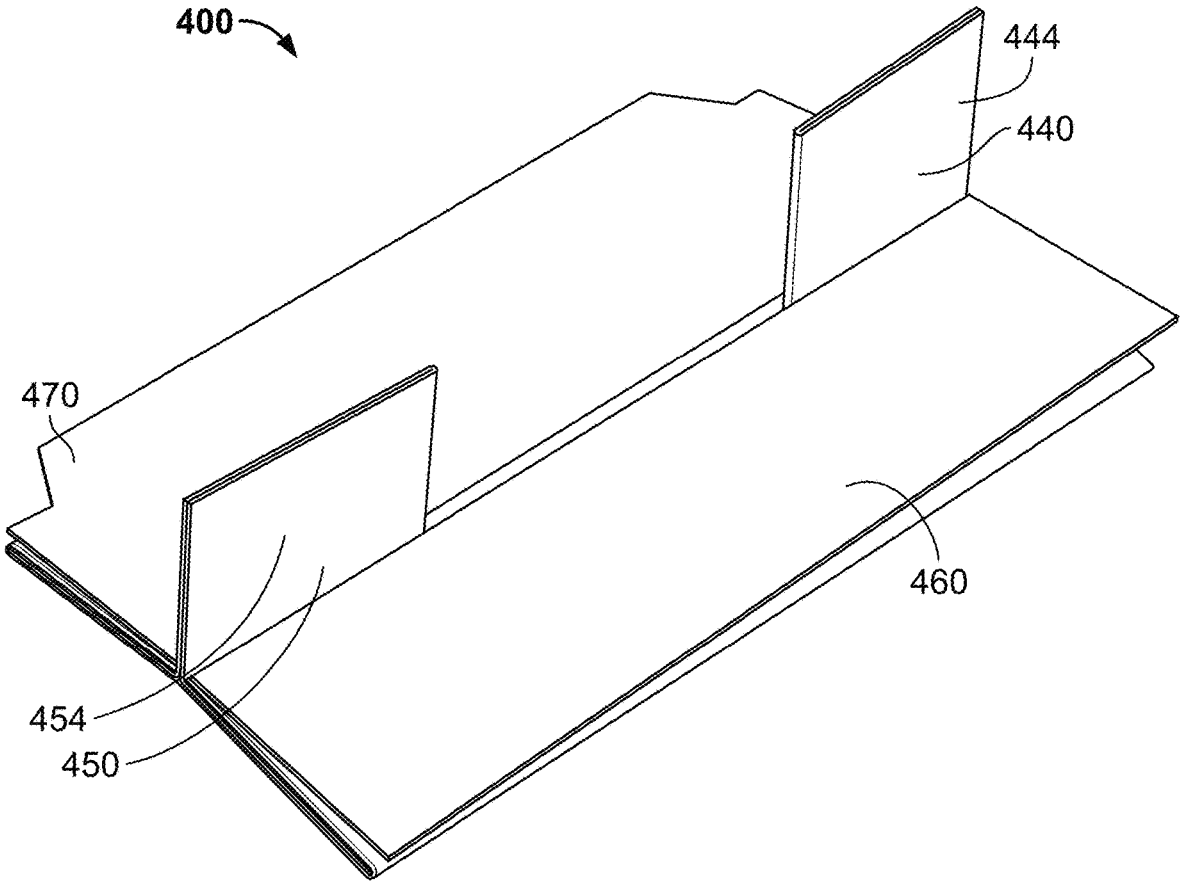
FIG. 4B illustrates a view of the box in a partially unfolded configuration, as the box is beginning to be unfolded into an open and packable configuration.
Figure 4C:
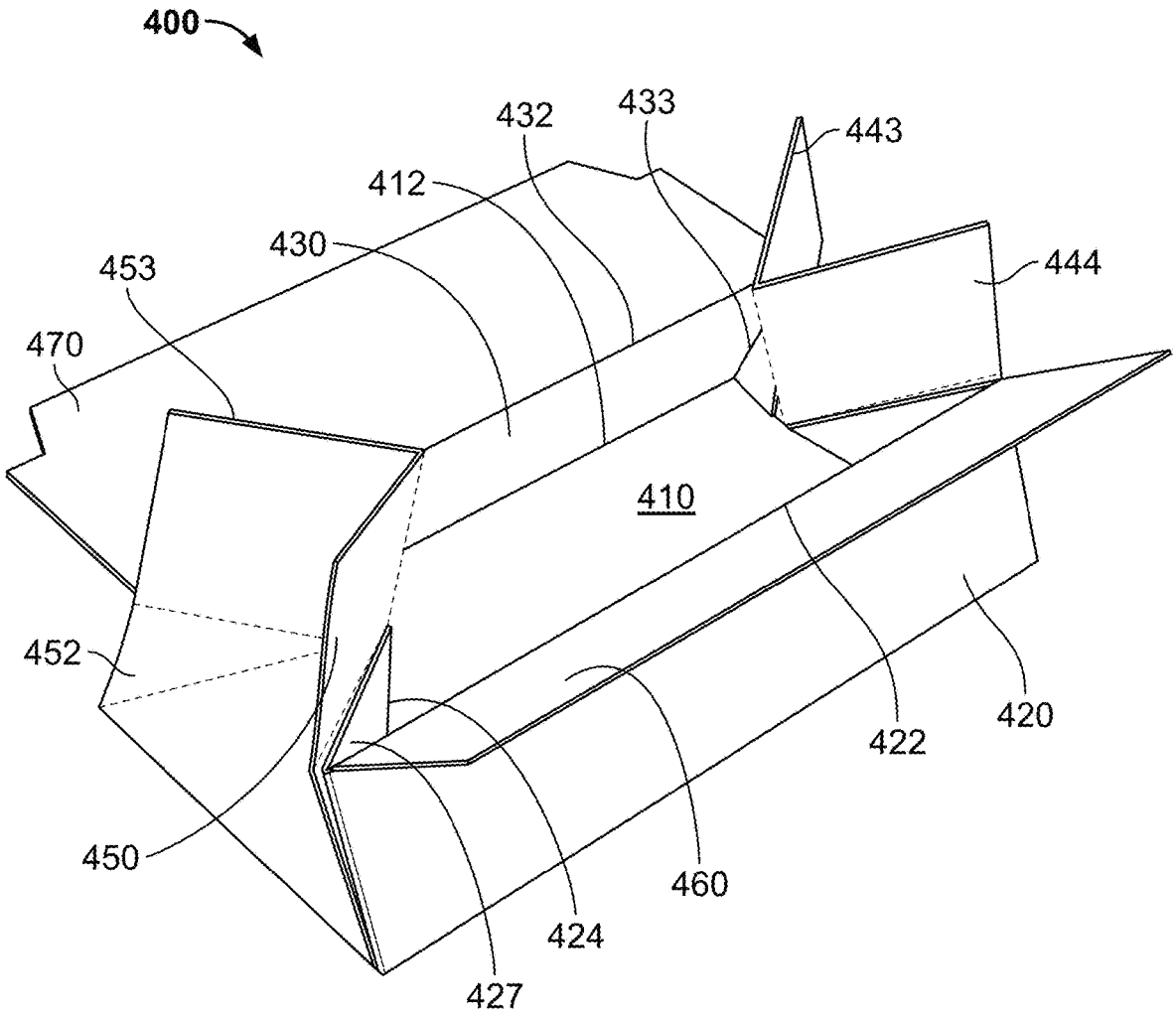
FIG. 4C illustrates a view of the box in a partially unfolded configuration, as the box is further unfolded into an open and packable configuration.
Figure 4D:
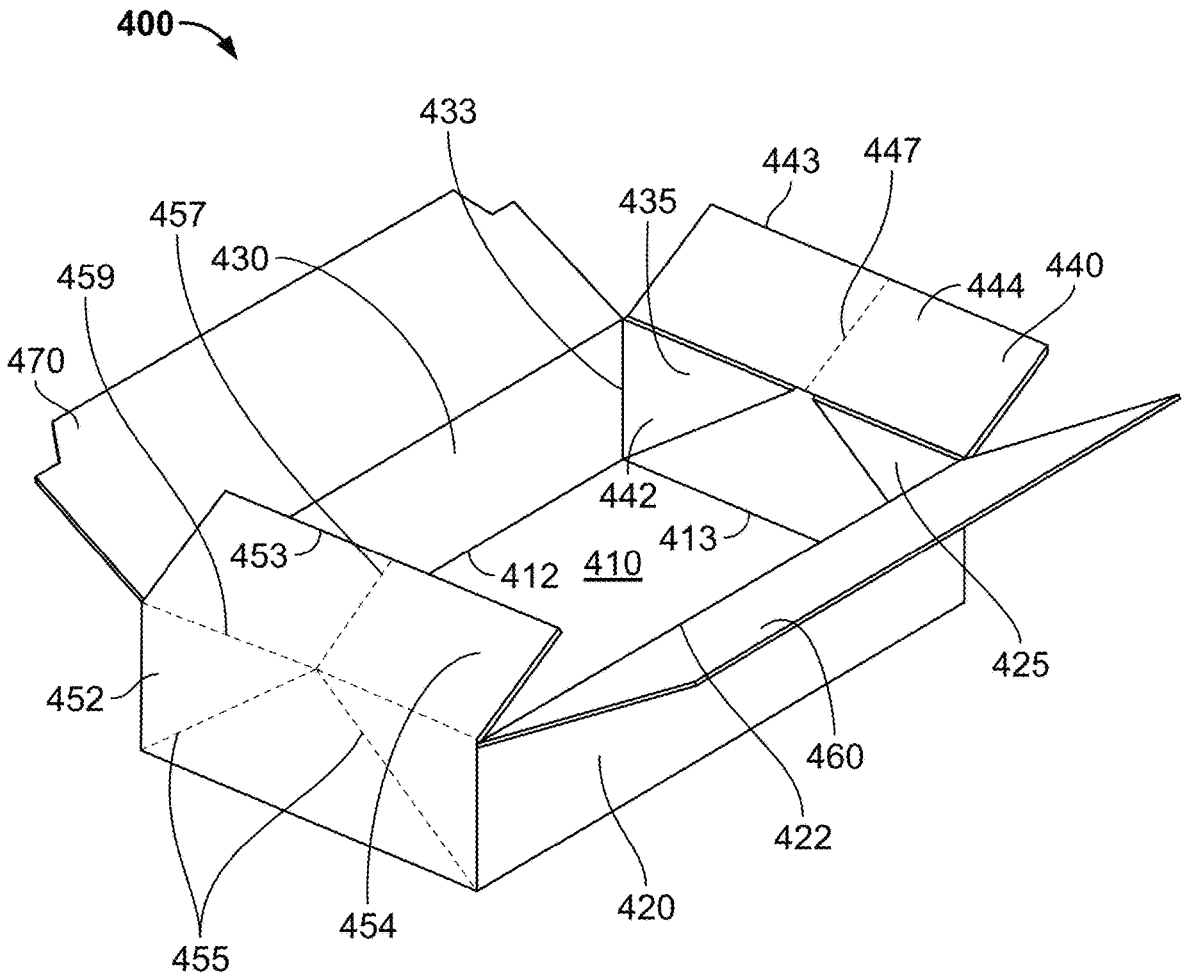
FIG. 4D illustrates a view of the box in an unfolded configuration, as the box is unfolded into an open and packable configuration.

FIGS. 4A to 4D illustrate a box according to the present disclosure moving from a folded stored configuration (FIG. 4A) as it is unfolded (FIGS. 4B and 4C) into an open and packable configuration (FIG. 4D). The box 400 may be formed from the box die 100 shown in FIGS. 1-3, and may contain corresponding panels and edges such that the box 400 is identical or very similar to the box die 100, except that the box is in an assembled state.

As shown in FIG. 4A, when the box 400 is folded into the stored configuration, a second top panel 470 may fold onto a second main wall panel 430 (not visible in FIG. 4A) with a first main wall panel 460 folded on top of the second top panel 470. Alternatively, and not as shown in FIG. 4A, the first main wall panel 460 may fold onto a first main wall panel 420 with the second main wall panel 430 folded on top of the first top panel 460. The first top panel 460 may be attached to the first main wall panel 420 along a first distal main wall longitudinal edge 422. Similarly, the second top panel 470 may be attached to the second main wall panel 430 along a second distal main wall longitudinal edge 432 (not visible in FIG. 4A).

FIG. 4B illustrates how the box 400 may look as the box 400 begins to be unfolded from the stored configuration. As shown in FIG. 4B, the second top panel 470 is still folded onto the second main wall panel 430. Now, the first top panel 460 is folded onto the first main wall panel 420. A first scored sidewall panel 440 comprising a first distal scored sidewall section 444 and a second scored sidewall panel 450 comprising a second distal scored sidewall section 454 are now exposed and visible. Both scored sidewall panels are in a folded configuration, where the first and second distal scored sidewall sections 444, 454 are folded in half. The folding of the first and second distal scored sidewall sections 444, 454 may allow the box 400 to fold in on its itself with a small or relatively small overall footprint (in other words, the overall area occupied by the box 400 is similar to the surface area of a base panel 410 of the box 400).

FIG. 4C illustrates how the box 400 may look as the box 400 is closer to being be unfolded from the stored configuration into an open and packable configuration. Now, the base panel 410 is visible. As shown, the base panel 410 is attached to the second main wall panel 430 along a second base longitudinal edge 412. Similarly, the base panel 410 is attached to the first main wall panel 420 along a first base longitudinal edge 411 (not visible in FIG. 4C). The base panel 410 is also attached to a first scored sidewall panel 440 via a first base lateral edge 413 (not visible in FIG. 4C) and a second scored sidewall panel 450 via a second base lateral edge 414 (not visible in FIG. 4C). The first scored sidewall panel 440 may be divided into a first proximal scored sidewall section 442 that comprises a first proximal scoring pattern 455 and a first distal scored sidewall section 444 that comprises a first distal scoring pattern 447. The second scored sidewall panel 450 may be divided into a second proximal scored sidewall section 452 that comprises a second proximal scoring pattern 455 and a second distal scored sidewall section 454 that comprises a second distal scoring pattern 457. The first scored sidewall panel 440 may comprise a first distal sidewall edge 443 opposing the first base lateral edge 413. The second scored sidewall panel 450 may comprise a second distal sidewall edge 453 opposing the second base lateral edge 414.

According to certain aspects of the present disclosure, first and second tabs 425, 427 may be attached to the first main wall panel 420 at each of the opposing main wall lateral edges 423 and 424, respectively. Similarly, according to certain aspects of the present disclosure, third and fourth tabs 435, 437 may be attached to the second main wall panel 430 at each of the opposing main wall lateral edges 433 and 434, respectively. Each of the tabs 425, 427, 435, 437 may be configured to overlap and attach to the first and second scored sidewall panels 440, 450. Typically, the first and third tabs 425, 435 would overlap and attach to the first scored sidewall panel 440, and the second and fourth tabs 427, 437 would overlap and attach to the second scored sidewall panel 450. While the tabs 425, 427, 435, 437 may be fixedly (e.g., permanently) or temporarily attached to the first and second scored sidewall panels 440, 450, typically the tabs will be fixedly attached. The attachment could be made by an adhesive, such as glue or tape. Typically, the first and third tabs 425, 435 will be configured to align with the first proximal scoring pattern, to allow the first proximal scored sidewall section 442 to fold inwards towards the base panel 410. Similarly, typically, the second and fourth tabs 427, 437 will be configured to align with the second proximal scoring pattern, to allow the second proximal scored sidewall section 452 to fold inwards towards the base panel 410. For example, according to certain embodiments, the tabs 425, 427, 435, 437 may be triangular in shape (e.g., right angled triangles) with the hypotenuse of each triangular-shaped tab configured to attach and align with the first and second proximal scoring patterns 445, 455 when the first and second proximal scoring patterns 445, 455 each comprise two score lines that extend from opposite ends of the relevant base lateral edge (413 or 414) to converge where the first or second proximal scoring pattern (445 or 455) meets the relevant lateral scoring pattern (449 or 459).

Figure 5:
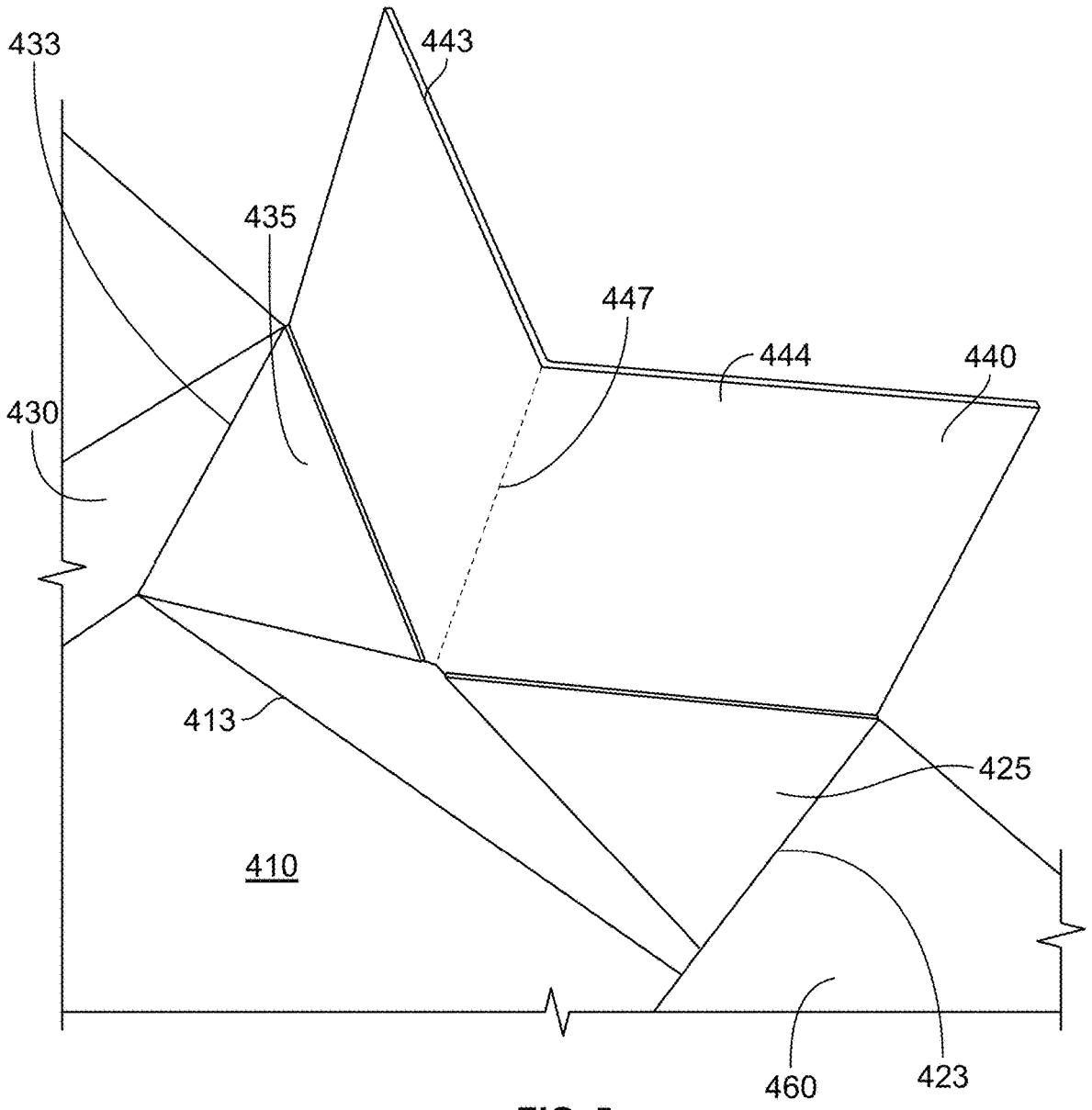
FIG. 5 illustrates a partial enlarged view of the box as the box is unfolded into an open and packable configuration.

FIG. 5 illustrates a partial enlarged view of the box as the box is unfolded into an open and packable configuration. This figure focuses primarily on the first scored sidewall panel, and shows how the first distal scored sidewall section 444 may fold along the first distal scoring pattern 447.

Figure 6:
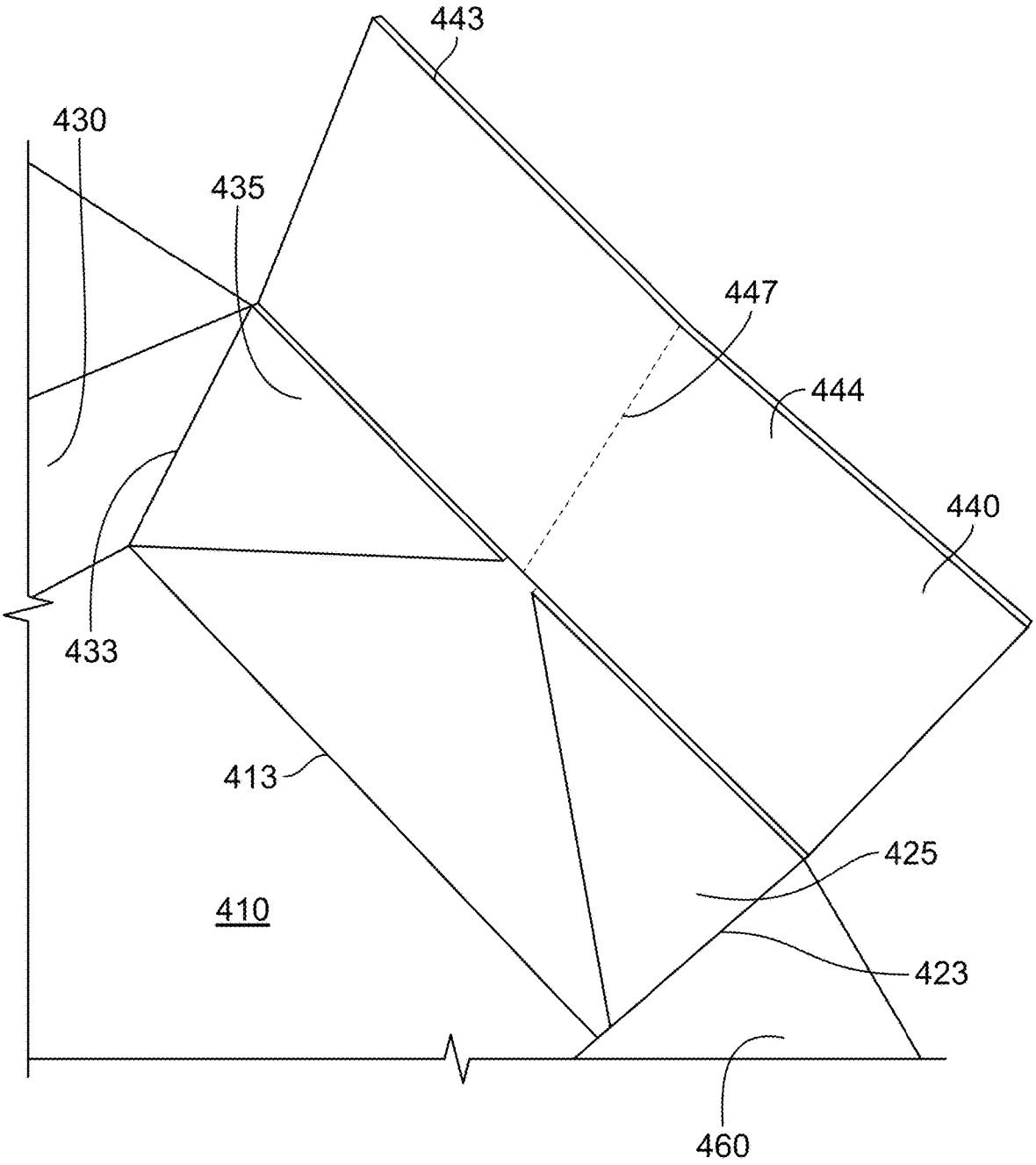
FIG. 6 illustrates a partial enlarged view of the box as the box is in an open and packable configuration.

FIG. 6 illustrates a partial enlarged view of the box as the box is in an open and packable configuration. This figure focuses primarily on the first scored sidewall panel, and shows how the first distal scored sidewall section 444 may be flat along the first distal scoring pattern 447 when the box is in an open and packable configuration.

Figure 7:
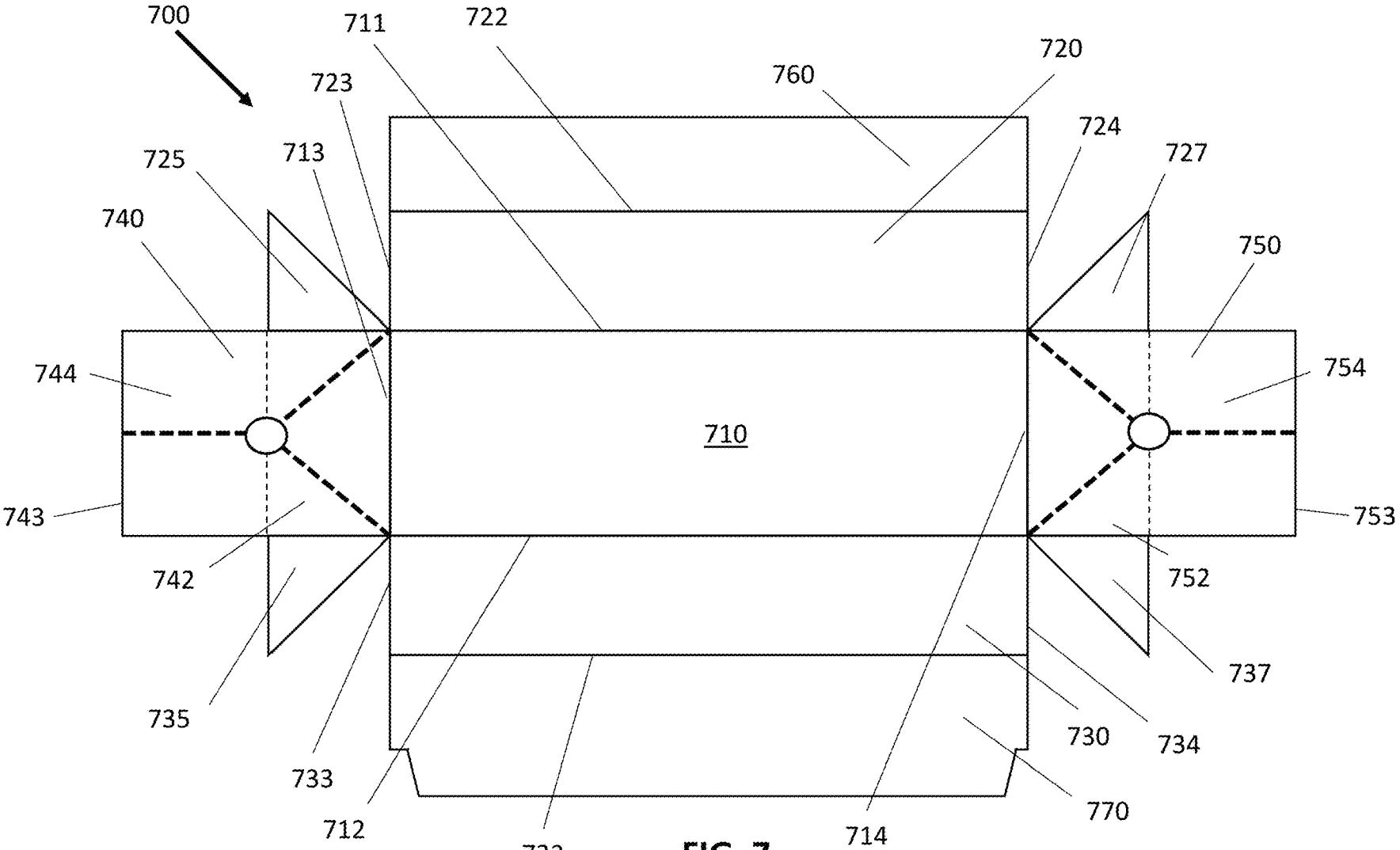
FIG. 7 illustrates a bottom plan view of a box die according to the present disclosure.
Figure 8:
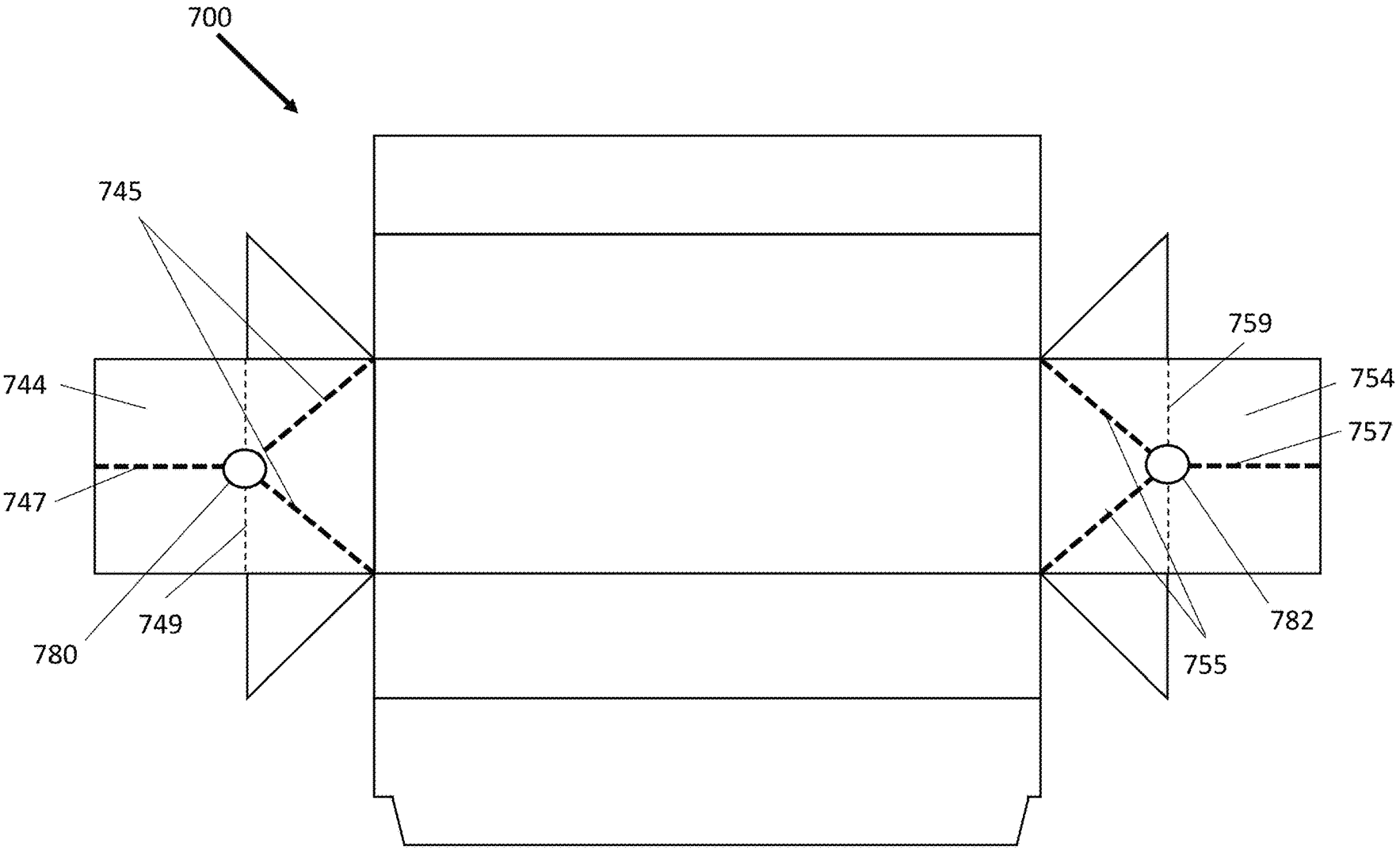
FIG. 8 illustrates a bottom plan view of a box die according to the present disclosure, showing an example scoring pattern.

FIGS. 7 and 8 illustrate a bottom plan view of an embodiment of a box die 700 according to the present disclosure. Structurally, the box die 700 may substantially correspond to the box die 100 shown in FIGS. 1-3, and thus may have corresponding features, such as a first main wall panel 720, opposing main wall lateral edges 723 and 724, respectively, a second main wall panel 730, opposing main wall lateral edges 733 and 734, respectively, and first and second scored sidewall panels 740, 750. The box die 700 may similarly include a first scored sidewall panel 740 attached to the base panel 710 along the first base lateral edge 713. The first scored sidewall panel 740 may be divided into a first proximal scored sidewall section 742 that comprises a first proximal scoring pattern 745 and a first distal scored sidewall section 744 that comprises a first distal scoring pattern 747. A first lateral scoring pattern 749 may divide the first proximal scored sidewall section 742 from the first distal scored sidewall section 744.

The first distal scoring pattern 747 may comprise a score line that extends perpendicular from the first distal sidewall edge 143 to the first lateral scoring pattern 149. The first lateral scoring pattern 149 may be configured to allow the first distal scored sidewall section 144 as a whole to fold inwards towards the base panel 110 after the box has been packed so that the box may then be closed. The first lateral scoring pattern 749 may comprise a score line that extends substantially parallel to the second base lateral edge 713. The second lateral scoring pattern 759 may comprise a score line that extends substantially parallel to the second base lateral edge 714.

Nonetheless, the box die 700 may have certain distinctions as compared to the box die 100. For example, the box die 700 may include a first tab 725 that is attached to the first scored sidewall panel 740 (instead of to main wall lateral edge 723), and a second tab 727 that is attached to the second scored sidewall panel 750 (instead of to main wall lateral edge 724). Similarly, the box die 700 may include a third tab 735 that is attached to the first scored sidewall panel 740 (instead of to main wall lateral edge 733), and a fourth tab 737 that is attached to the second scored sidewall panel 750 (instead of to main wall lateral edge 734). The placement of the first tab 725, second tab 727, third tab 735, and fourth tab 737 may aid in sturdiness and/or handling of weight distribution of the box once unfolded such as described in FIGS. 4A-4D.

Although the first tab 725 and second tab 727 are illustrated as being attached to the first scored sidewall panel 740 and second scored sidewall panel 750, the first tab 725 and second tab 727 may be attached to the main lateral wall edges 723, 724. Similarly, although the third tab 735 and fourth tab 737 are illustrated as being attached to the first scored sidewall panel 740 and second scored sidewall panel 750, the third tab 735 and fourth tab 737 may be attached to the main wall lateral edges 733, 734.

In the box die 700, the first proximal scoring pattern 745, the first distal scoring pattern 747, the second proximal scoring pattern 755, and the second distal scoring pattern 757 may each be perforated or more deeply scored relative to the first lateral scoring pattern 749 and the second lateral scoring pattern 759. An advantage of perforating or more deeply scoring the scoring patterns 745, 755 is that it may allow the box to be folded more flat (thus with an even thinner profile) when in a stored folded configuration, such as illustrated in FIGS. 4A and 4B, for example.

In some examples, the box die 700 includes an aperture 780 at an intersection of the first proximal scoring pattern 745, the first distal scoring pattern 747, and the first lateral scoring pattern 749. The aperture 780 may provide for additional folding capabilities and/or may allow the folding at first proximal scoring pattern 745, the first distal scoring pattern 747, and the first lateral scoring pattern 749 to be performed more easily. Similarly, the second scored sidewall panel 750 may include an aperture 782 at an intersection of the second proximal scoring pattern 755, the second distal scoring pattern 757, and the second lateral scoring pattern 759.

Figure 9:
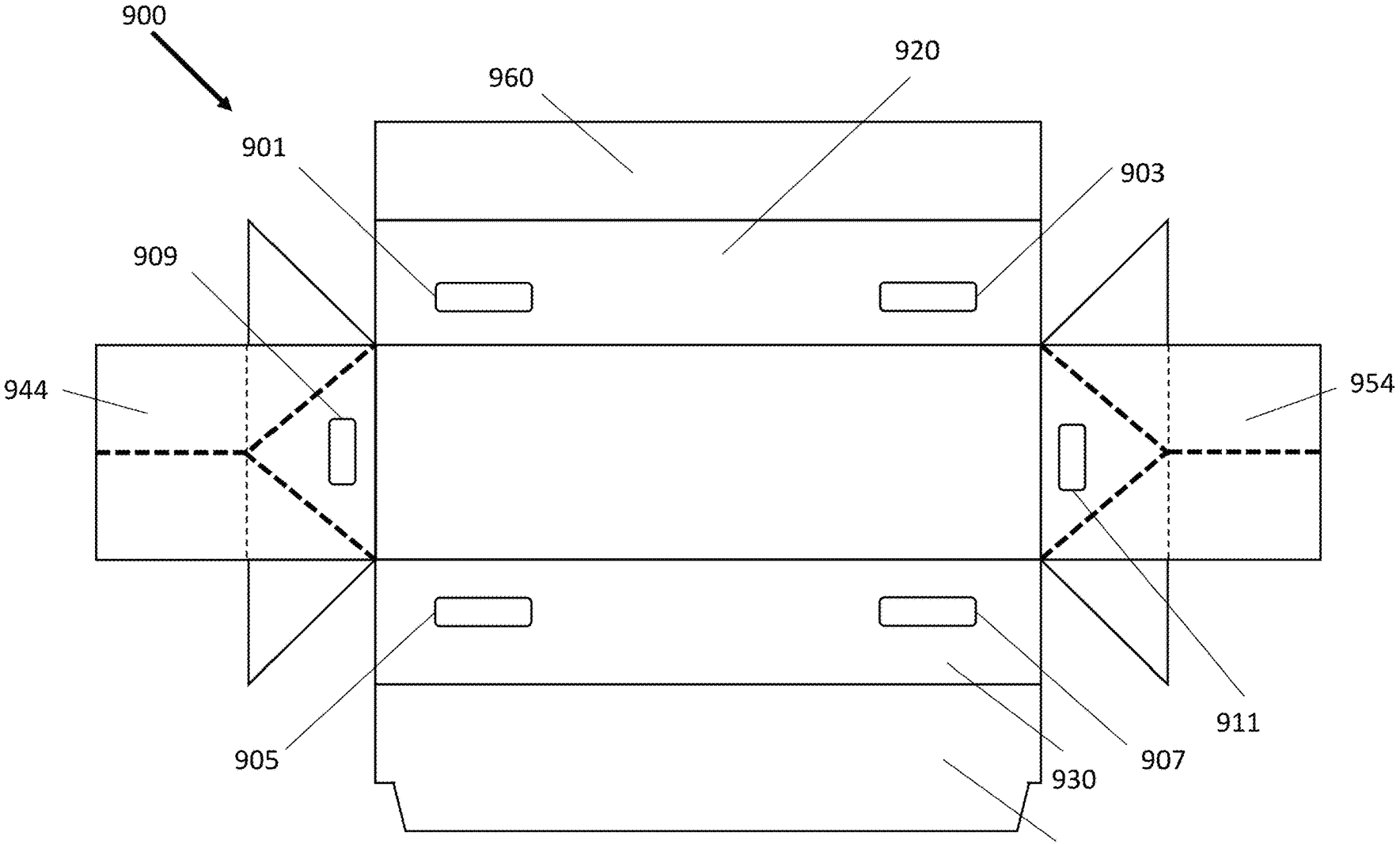
FIG. 9 illustrates a bottom plan view of a box die according to the present disclosure, in which the box die includes one or more handles.

FIG. 9 illustrates a bottom plan view of an embodiment of a box die 900 according to the present disclosure. The box die 900 may be identical to box die 700 shown in FIGS. 7 and 8 except that FIG. 9 includes one or more handles. For example, the first distal scored sidewall section 944, the second distal scored sidewall section 954, the first main wall panel 920, and/or the second main wall panel 930 may each include one or handles. As illustrated, the first main wall panel 920 may include handle 901 and/or handle 903, the second main wall panel 930 may include handle 905 and/or handle 907, the first distal scored sidewall section 944 may include handle 909, and/or the second distal scored sidewall section 954 may include handle 911. Although two handles 901, 903, 905, 907 are depicted on each of the first main wall panel 920 and second main wall panel 930, more or fewer handles may be included. Although a handle 909, 911 is depicted on each of the first distal scored sidewall section 944 and the second distal scored sidewall section 954, more or fewer handles may be included. In some examples, the first main wall panel 920 and second main wall panel 930 may not include handles 901, 903, 905, 907, and each of the first distal scored sidewall section 944 and the second distal scored sidewall section 954 may include handle 909 and handle 911 respectively. In some other examples, the first distal scored sidewall section 944 and the second distal scored sidewall section 954 may include handles 909, 911, and the first main wall panel 920 and second main wall panel 930 may not include handles 901, 903, 905, 907. In some other examples, one or more handles may be placed on the first top panel 960 and/or the second top handle 970.

Although handles 901, 903, 905, 907, 909, 911 are depicted as rectangular, other shapes may be used. For example, the handles 901, 903, 905, 907, 909, 911 may be circular, oval, square, triangular, polygonal, etc.

According to aspects of the present disclosure, the box has a relatively small footprint, such that the box does not occupy a substantially greater surface area when in a stored, folded configuration as compared to when the box is in an open and packable configuration. For example, the surface area of the box in the stored configuration may occupy the same or substantially the same surface area as base panel 110. According to other embodiments, the surface area of the box in the stored configuration may occupy no more than 15%, 10%, or 5% more than the surface area as base panel 110.

While various spatial and directional terms, such as top, bottom, lower, mid, lateral, horizontal, proximal, distal, vertical, and front may be used herein to describe embodiments of the present invention, it is understood that such terms are used with respect to the orientations shown in the drawings and do not necessary indicate a specific orientation. According to certain embodiments on configurations, the described orientations may be inverted, rotated, or otherwise changed, such that, for example, an upper portion becomes a lower portion or horizontal becomes vertical.

The various aspects and embodiments disclosed herein are not intended to be limiting. Other embodiments may be utilized, and other changes may be made, without departing from the spirit or scope of the subject matter presented herein. It will be readily understood that the aspects of the present disclosure, as generally described herein and illustrated in the figures, can be arranged, substituted, combined, separated, and designed in a wide variety of different configurations, all of which are contemplated herein.

The invention claimed is:

1. A quick-assembly box configured to be unfolded from a stored configuration into an open and packable configuration, comprising:

a base panel comprising a first base longitudinal edge opposing a second base longitudinal edge, and a first base lateral edge opposing a second base lateral edge;

a first main wall panel that is attached to the base panel along the first base longitudinal edge, wherein the first main wall panel comprises a first distal main wall longitudinal edge opposing the first base longitudinal edge, and two opposing main wall lateral edges that extend from the first base longitudinal edge to the first distal main wall longitudinal edge;

a second main wall panel that is attached to the base panel along the second base longitudinal edge, wherein the second main wall panel comprises a second distal main wall longitudinal edge opposing the second base longitudinal edge, and two opposing main wall lateral edges that extend from the second base longitudinal edge to the second distal main wall longitudinal edge;

a first scored sidewall panel that is attached to the base panel along the first base lateral edge, wherein the first scored sidewall panel comprises a first proximal scoring pattern, and a first distal sidewall edge opposing the first base lateral edge;

a second scored sidewall panel that is attached to the base panel along the second base lateral edge, wherein the second scored sidewall panel comprises a second proximal scoring pattern, and a second distal sidewall edge opposing the second base lateral edge;

a first top panel that is attached to the first main wall panel along the first distal main wall longitudinal edge;

a second top panel that is attached to the second main wall panel along the second distal main wall longitudinal edge;

wherein the first and second proximal scoring patterns allow at least a lower portion of the first and second scored sidewall panels to fold towards the base panel when the box is folded into the stored configuration;

wherein the first scored sidewall panel includes a first proximal scored sidewall section comprising the first proximal scoring pattern, a first distal scored sidewall section comprising an outer surface and a first distal scoring pattern, and a first lateral scoring pattern that divides the first proximal scored sidewall section from the first distal scored sidewall section; and wherein the first and second main wall panels are each a unitary piece of material with no crease or score lines within each main wall panel.

2. The quick-assembly box of claim 1, wherein the first proximal scoring pattern comprises two score lines extending from opposite ends of the first base lateral edge and converging where the first proximal scoring pattern meets the first lateral scoring pattern.

3. The quick-assembly box of claim 1, wherein the first distal scoring pattern comprises a score line that extends perpendicular from the first distal sidewall edge to the first lateral scoring pattern, wherein the first distal scoring pattern allows the first distal scored sidewall section to fold such that the outer surface folds in on itself when the box is folded into the stored configuration.

4. The quick-assembly box of claim 1, wherein the first lateral scoring pattern comprises a score line that extends substantially parallel to the first base lateral edge, wherein the first lateral scoring pattern allows the first distal scored sidewall section to fold such that the outer surface remains substantially flat and the first distal scored sidewall section folds towards the base panel when the box is unfolded into the open and packable configuration.

5. The quick-assembly box of claim 1, wherein the second scored sidewall panel includes a second proximal scored sidewall section comprising the second proximal scoring pattern, a second distal scored sidewall section comprising an outer surface and a second distal scoring pattern, and a second lateral scoring pattern that divides the second proximal scored sidewall section from the second distal scored sidewall section.

6. The quick-assembly box of claim 5, wherein the second proximal scoring pattern is the same as the first proximal scoring pattern, the second distal scoring pattern is the same as the first distal scoring pattern, and the second lateral scoring pattern is the same as the first lateral scoring pattern.

7. The quick-assembly box of claim 6, wherein the first proximal scoring pattern comprises two score lines extending from opposite ends of the first base lateral edge and converging where the first proximal scoring pattern meets the first lateral scoring pattern, wherein the second proximal scoring pattern comprises two score lines extending from opposite ends of the second base lateral edge and converging where the second proximal scoring pattern meets the second lateral scoring pattern, wherein the first, second, third, and fourth tabs are triangular, and wherein the hypotenuse of each triangular tab aligns with one of the score lines of the first and second proximal scoring patterns.

8. The quick-assembly box of claim 5, wherein the first proximal scoring pattern, the second proximal scoring pattern, the first distal scoring pattern, and the second distal scoring pattern are each perforated.

9. The quick-assembly box of claim 8, further comprising a first aperture located at an intersection between the first proximal scoring pattern and the first distal scoring pattern and a second aperture located at an intersection between the second proximal scoring pattern and the second distal scoring pattern.

10. The quick-assembly box of claim 1 further comprising a first and second tab attached to the first main wall panel at each of the opposing main wall lateral edges and a third and fourth tab attached to the second main wall panel at each of the opposing main wall lateral edges, and wherein the first and second tab are attached to the first and second scored sidewall panel respectively and the third and fourth tab are attached to the first and second scored sidewall panel respectively.

11. The quick-assembly box of claim 10, wherein the first, second, third, and fourth tabs are permanently attached to the first and second scored sidewall panels.

12. The quick-assembly box of claim 1, wherein, when the box is folded into the stored configuration, either the first top panel folds onto the first main wall panel with the second top panel then folding on top of the first top panel, or the second top panel folds onto the second main wall panel with the first top panel then folding on top of the second top panel.

13. The quick-assembly box of claim 1, wherein the box occupies an overall surface area in the stored configuration that is defined by an area of a flat surface that the box covers when the box is placed on the flat surface, and wherein the base panel occupies a surface area that is defined by an area of a flat surface that the base panel covers when the box is placed on the flat surface, and wherein the overall surface area occupied by the box in the stored configuration is no more than 5% greater than the surface area occupied by the base panel.

14. The quick-assembly box of claim 1, wherein the quick-assembly box is formed from a single, unitary piece of material, with crease or score lines or joins or attachments between the different panels.

15. The quick-assembly box of claim 1, wherein the base panel is a unitary piece of material with no crease or score lines within the base panel.

16. The quick-assembly box of claim 1, wherein the first top panel, the second top panel, or both, further comprises a fastener that is configured to attach the first and second top panels together to maintain the box in the stored configuration.

17. A quick-assembly box configured to be unfolded from a stored configuration into an open and packable configuration, comprising:

a base panel comprising a first base longitudinal edge opposing a second base longitudinal edge, and a first base lateral edge opposing a second base lateral edge;

a first main wall panel that is attached to the base panel along the first base longitudinal edge, wherein the first main wall panel comprises a first distal main wall longitudinal edge opposing the first base longitudinal edge, and two opposing main wall lateral edges that extend from the first base longitudinal edge to the first distal main wall longitudinal edge;

a second main wall panel that is attached to the base panel along the second base longitudinal edge, wherein the second main wall panel comprises a second distal main wall longitudinal edge opposing the second base longitudinal edge, and two opposing main wall lateral edges that extend from the second base longitudinal edge to the second distal main wall longitudinal edge;

a first scored sidewall panel that is attached to the base panel along the first base lateral edge, wherein the first scored sidewall panel comprises a first proximal scoring pattern, and a first distal sidewall edge opposing the first base lateral edge;

a second scored sidewall panel that is attached to the base panel along the second base lateral edge, wherein the second scored sidewall panel comprises a second proximal scoring pattern, and a second distal sidewall edge opposing the second base lateral edge;

a first top panel that is attached to the first main wall panel along the first distal main wall longitudinal edge;

a second top panel that is attached to the second main wall panel along the second distal main wall longitudinal edge;

wherein the first and second proximal scoring patterns allow at least a lower portion of the first and second scored sidewall panels to fold towards the base panel when the box is folded into the stored configuration;

wherein the first scored sidewall panel includes a first proximal scored sidewall section comprising the first proximal scoring pattern, a first distal scored sidewall section comprising an outer surface and a first distal scoring pattern, and a first lateral scoring pattern that divides the first proximal scored sidewall section from the first distal scored sidewall section; and wherein the second top panel further comprises a seal that is configured to attach to the first top panel to seal the box from an open and packable configuration into a closed and packed configuration.

18. The quick-assembly box of claim 17, wherein the second top panel further comprises a protruding area, and wherein the seal is located within the protruding area.

19. The quick-assembly box of claim 17, wherein the quick-assembly box is formed from a single, unitary piece of material, with crease or score lines or joins or attachments between the different panels.

20. A quick-assembly box configured to be unfolded from a stored configuration into an open and packable configuration, comprising:

a base panel comprising a first base longitudinal edge opposing a second base longitudinal edge, and a first base lateral edge opposing a second base lateral edge;

a first main wall panel that is attached to the base panel along the first base longitudinal edge, wherein the first main wall panel comprises a first distal main wall longitudinal edge opposing the first base longitudinal edge, and two opposing main wall lateral edges that extend from the first base longitudinal edge to the first distal main wall longitudinal edge;

a second main wall panel that is attached to the base panel along the second base longitudinal edge, wherein the second main wall panel comprises a second distal main wall longitudinal edge opposing the second base longitudinal edge, and two opposing main wall lateral edges that extend from the second base longitudinal edge to the second distal main wall longitudinal edge;

a first scored sidewall panel that is attached to the base panel along the first base lateral edge, wherein the first scored sidewall panel comprises a first proximal scoring pattern, and a first distal sidewall edge opposing the first base lateral edge;

a second scored sidewall panel that is attached to the base panel along the second base lateral edge, wherein the second scored sidewall panel comprises a second proximal scoring pattern, and a second distal sidewall edge opposing the second base lateral edge;

a first top panel that is attached to the first main wall panel along the first distal main wall longitudinal edge;

a second top panel that is attached to the second main wall panel along the second distal main wall longitudinal edge;

wherein the first and second proximal scoring patterns allow at least a lower portion of the first and second scored sidewall panels to fold towards the base panel when the box is folded into the stored configuration;

wherein the first scored sidewall panel includes a first proximal scored sidewall section comprising the first proximal scoring pattern, a first distal scored sidewall section comprising an outer surface and a first distal scoring pattern, and a first lateral scoring pattern that divides the first proximal scored sidewall section from the first distal scored sidewall section; and wherein the first top panel, the second top panel, or both, further comprises a fastener that is configured to attach one of the first and second top panels to the base panel to maintain the box in the stored configuration.

* * * * *